US011509096B2

(12) United States Patent
Mougin et al.

(10) Patent No.: US 11,509,096 B2
(45) Date of Patent: Nov. 22, 2022

(54) CONNECTOR WITH INTERFACE PART MOUNTED TO ROTATE IN THE CASING AND ADAPTED TO BE ACTUATED BY A TOOL TO SLIDE A CAP LOCKING IT ONTO A COMPLEMENTARY CONNECTOR

(71) Applicant: RADIALL SA, Aubervilliers (FR)

(72) Inventors: Sylvain Mougin, Le Boulay (FR); Romain Vincent, Neuville sur Brenne (FR); Stéphane Moyon, Auzouer en Touraine (FR)

(73) Assignee: RADIALL, Aubervilliers (FR)

( * ) Notice: Subject to any disclaimer, the term of this patent is extended or adjusted under 35 U.S.C. 154(b) by 0 days.

(21) Appl. No.: 17/192,077

(22) Filed: Mar. 4, 2021

(65) Prior Publication Data

US 2021/0281015 A1 Sep. 9, 2021

(30) Foreign Application Priority Data

Mar. 9, 2020 (FR) ..... 2002296

(51) Int. Cl.
*H01R 13/625* (2006.01)
*H01R 13/639* (2006.01)

(52) U.S. Cl.
CPC ..... *H01R 13/639* (2013.01); *H01R 2201/26* (2013.01)

(58) Field of Classification Search
CPC ..... H01R 13/639; H01R 13/62
See application file for complete search history.

(56) References Cited

U.S. PATENT DOCUMENTS 1,549,433 A * 8/1925 Benjamin ..... H02G 3/20 248/224.8
4,172,627 A * 10/1979 Ricros ..... H01R 13/6275 439/347
5,478,251 A * 12/1995 Jaklin ..... H01R 13/6275 439/157
5,480,319 A * 1/1996 Vlakancic ..... H01R 13/641 439/490
7,070,438 B2 * 7/2006 Dillon ..... H01R 13/62977 439/372
7,329,138 B2 2/2008 Van Der Mee et al.
7,497,706 B2 * 3/2009 Daudin ..... H01R 13/518 439/157
7,695,296 B1 * 4/2010 Hitchcock ..... H01R 13/62922 439/372

(Continued)

FOREIGN PATENT DOCUMENTS

DE 41 39 723 A1 6/1993
DE 10 2011 005 508 A1 9/2012

(Continued)

OTHER PUBLICATIONS

French Search Report for corresponding French Application No. FR 2002296 dated Oct. 29, 2020.

*Primary Examiner* — Neil Abrams
(74) *Attorney, Agent, or Firm* — Pearne & Gordon LLP

(57) ABSTRACT

The application comprises a mechanism for transformation of the movement in rotation by a tool of an interface part housed in the casing of a connector into movement in translation in a plane perpendicular to the coupling direction of a locking cap for locking the casing of the connector to that of a complementary connector.

15 Claims, 8 Drawing Sheets

(56) References Cited

U.S. PATENT DOCUMENTS

| | | | | |
|---|---|---|---|---|
| 7,918,675 | B2 * | 4/2011 | Van Den Meersschaut | H01R 13/62911 439/157 |
| 8,235,742 | B2 * | 8/2012 | Komiyama | H01R 13/62911 439/372 |
| 8,651,883 | B2 | 2/2014 | Becavin et al. | |
| 8,794,993 | B2 * | 8/2014 | Norton | F16L 37/56 439/372 |
| 8,992,240 | B2 * | 3/2015 | Shiga | H01R 13/62911 439/157 |
| 9,865,961 | B2 * | 1/2018 | Shibaya | H01R 13/639 |
| 9,865,966 | B2 * | 1/2018 | Matsuura | H01R 13/62922 |
| 10,333,251 | B2 * | 6/2019 | Miyamura | H01R 13/639 |
| 10,530,094 | B2 * | 1/2020 | Furuya | H01R 13/62916 |
| 2006/0223373 | A1 | 10/2006 | Van Der Mee et al. | |
| 2012/0244737 | A1 | 9/2012 | Becavin et al. | |
| 2021/0281015 | A1 * | 9/2021 | Mougin | H01R 13/6395 |

FOREIGN PATENT DOCUMENTS

| | | |
|---|---|---|
| EP | 1 708 313 B1 | 3/2011 |
| EP | 2 503 651 B1 | 5/2013 |

* cited by examiner

CONNECTOR WITH INTERFACE PART MOUNTED TO ROTATE IN THE CASING AND ADAPTED TO BE ACTUATED BY A TOOL TO SLIDE A CAP LOCKING IT ONTO A COMPLEMENTARY CONNECTOR

TECHNICAL FIELD

The present invention concerns the field of electrical connectors.

The aim of the invention is in particular to improve the mutual locking between two complementary connector casings, in particular multi-contact connector casings, when they are in a connected configuration.

Although described with reference to a preferred application, aeronautics, and more particularly the field of equipment onboard an aircraft, the invention may be used in any other application.

PRIOR ART

In many connection applications it is known to interlock a connector and the complementary one of the same assembly, once their connection configuration has been achieved, that is to say the coupling between their respective contacts assured.

This is particularly necessary when the environment of the connection assembly is subjected to severe environmental constraints, as may be the case in aircraft and in particular when the assembly is mounted on a panel of equipment onboard an aircraft.

A number of solutions have already been employed as locking means.

Firstly there is known a nut-and-bolt locking system that is found for example in the connection assemblies sold by the Applicant under the designation EPX®B2: the receptacle carries a nut fixed to the casing in its central part between the two contact inserts, while the plug includes a central hole through which a bolt may be screwed into the nut to obtain the required locking.

Also known is a quarter-turn fixing system that is found for example in the connection assemblies sold by the Applicant under the designation EPX®A, EPX®B1: the receptacle carries on either side of the central housing a male cylinder provided with two outwardly projecting lugs and the plug carries a female cylinder with openings facing each of the male cylinders.

There has been represented in FIG. 1 a existing EPX®B1 plug 2 with its casing 20: fixing is assured by means of a screwdriver, by quarter-turn screwing in the direction of the arrow R of the interface imprint 21 of each female cylinder 22 that enables sliding of the lugs in the corresponding openings 23 as far as one of their ends to obtain the required locking. On the other hand, the generally successive actuations of these quarter-turn imprints 21 risks causing misalignment. An operative may even lock the second one imperfectly without noticing it. Moreover, the operating time is also longer.

Finally, it is widely known to use a locking cap that is actuated by manual sliding on the casing of one of the connectors, the cap comprising shapes cooperating with complementary shapes of the casing of the complementary connector to obtain the immobilisation in translation of the cap and therefore the required locking.

Thus the patent EP1708313B1 therefore proposes a connection assembly comprising a locking cap comprising locking teeth between two multi-contact connectors one of which is fixed to a support, the movement of the cap being effected by manually sliding it on the casing.

The patent EP2503651B1 also discloses a locking cap to be moved manually on the casing of one of the two multi-contact connectors, the other one being already mounted on an electronic equipment panel.

There has been reproduced in FIGS. 2A and 2B a connection assembly 1 with plug 2 and receptacle 3 that uses a locking cap 4 of the above kind. This connection assembly 1 is mounted on a panel P which is for example that of a casing for electronic equipment, in particular equipment onboard an aircraft, or in a disconnect panel. To be more precise, the receptacle 3 is mounted in an opening in the panel P to which the casing 30 of the receptacle 3 is fixed by means of screws 5.

The substantially U shape locking cap 4 is mounted to slide on the casing 20 of the plug 2 between its connection front face 24 and its rear face 25, perpendicularly to its longitudinal axis X. Each of the branches of the U comprises internally openings 40 with appropriate shapes. Each of the longitudinal faces 31 of the casing 30 of the receptacle 3 is provided with two lugs 32.

To effect the locking as shown in FIG. 2B an operative uses their finger to exert a lateral thrust T on the cap 4 from its unlocking position. The cap 4 is locked in its locking position by the wedging of each lug 32 on the casing 30 in an opening 40 of the cap 4.

Although the various locking systems with the various means described hereinabove have proven effective and reliable, the inventors have come to the conclusion that they are not able to solve problems with which they have recently been confronted.

Indeed, firstly, in the application concerned, the available space that has been allocated for mounting a plurality of connection assemblies on an electronic equipment panel is very limited.

To illustrate this space constraint, there has been shown in FIG. 3 the required arrangement in adjacent columns of a plurality of connection assemblies 1.1 to 1.6 individually mounted in an aircraft electronic equipment panel P. As is clear from this FIG. 3, the minimum gap E between two adjacent assemblies 1.1, 1.2 is very small. Now, this gap does not enable an operative to place a finger therein to cause manual sliding of a locking cap such as that described in the patents EP1708313B1 and EP2503651B1 mentioned above.

Then, it remains necessary to apply the usual coupling forces to guarantee the electrical continuity between the two casings, which is impossible to do manually in this new environment.

Thus there exists a need to improve further the mutual locking between complementary connectors in a connected configuration, in particular in order to have the possibility of easy locking in an environment constrained in terms of available space and/or that necessitates the application of a high locking force.

The invention aims to respond to all or part of that need.

SUMMARY OF THE INVENTION

To this end, in one of its aspects, the invention has for object a connector, in particular a multi-contact connector, comprising:

- a casing with a longitudinal axis (X), comprising a front face, termed the connection face, through which is made the connection to a connector of complementary type comprising a complementary casing, and a rear face, a cap for locking the connector to the complementary connector, said cap being mounted on the casing and adapted to side transversely relative to the longitudinal axis (X) of the casing between an unlocking position and a locking position between casing and complementary casing, a mechanism for transformation of movement in rotation into sliding of the locking cap, the mechanism comprising an interface part for a tool, the part being mounted to rotate freely in a housing of the casing and adapted to be rotated by the tool over an angular travel causing the locking cap to slide from its unlocking position to its locking position and vice versa.

By "vice versa" is meant here and in the context of the invention that the rotation by the tool over the angular travel in the opposite direction causes sliding of the cap from its locking position to its unlocking position.

The interface part is preferably adapted to be caused to move by a movement in rotation of the tool. The interface part may more preferably be caused to rotate about an axis parallel to the rotation axis of the tool, more preferably about the rotation axis of the tool.

The axis about which the interface part may be caused to rotate is preferably parallel to the longitudinal axis (X) of the casing.

The interface part is preferably housed in a housing passing through one side of the casing, preferably so that the interface between the interface part and the tool is on the longitudinal axis of the casing from the front or rear face of the latter.

In accordance with an advantageous variant embodiment, the interface part comprises an interface imprint for the tool, arranged on the side of the rear face of the casing.

The interface imprint for the tool is preferably arranged on a lateral edge of the casing.

The interface imprint of the part is more preferably a hollow hexagonal imprint. Of course, any type of imprint may be envisaged.

In accordance with an advantageous embodiment, the mechanism is a sliding mechanism in which:

the interface part comprises at its periphery a pin projecting toward the front face of the casing, the cap comprises a groove of complementary shape to that of the pin, the pin being mounted to slide in the groove, the shape of which is such that when the interface part is caused to rotate by the tool over the angular travel the pin sliding in the groove slides the cap from its unlocking position to its locking position and vice versa.

The end of travel position of the pin in the groove is advantageously adapted to generate for the operative effecting the locking using the tool a haptic indication of finalised locking of the cap in the locking position or in the vicinity of the latter. The pin is more advantageously able to continue to slide in the groove beyond the locking position and to generate for the operative a sensation of sudden reduction of the rotational torque.

The angular travel causing the sliding of the cap from its unlocking position to its locking position is preferably equal to at least 180°.

In accordance with another advantageous variant embodiment, the interface part comprises at its periphery a lug projecting from the side of the rear face of the casing, the lug forming an abutment for the interface part against a relief produced in or attached to the casing in the locking position and/or in the unlocking position of the cap.

The lug is preferably visible to the operative effecting the locking using the tool in any position of the cap.

In accordance with another advantageous variant embodiment, the connector comprises at least one visual indicator arranged so as to be visible to an operative in any position from the unlocking position of the cap to its locking position in which it is concealed.

The interface part advantageously comprises, by way of visual indicator, a coloured zone visible from the unlocking position of the cap to its locking position in which the zone is concealed by a relief in the casing or attached to the latter. This relief serves as an abutment for the lug of the interface part.

In accordance with one advantageous embodiment, the cap and the interface part are sized so as to generate a locking force of at least 100 N.

The connector may constitute a multi-contact connector in which the casing houses at least one insert including cells that extend along the longitudinal axis (X) and each of which houses a contact.

The locking cap advantageously having in a plane perpendicular to the longitudinal axis (X) a substantially U shape.

The invention further has for object an electrical connection assembly, comprising:

a connector as described above, a complementary connector.

In other words, the invention essentially consists in a mechanism for transformation of the movement in rotation by a tool of an interface part housed in the casing of a connector into a movement in translation in a plane perpendicular to the coupling direction of a locking cap for locking the casing of the connector to that of a complementary connector.

The mechanism very advantageously consists in a sliding mechanism with a projecting pin at the periphery of the interface part that comes to slide in a groove of the casing upon rotation of the tool. This sliding causes the movement in translation of the locking cap in a plane perpendicular to the coupling direction of the connector from its unlocking position to its locking position.

The haptic indication enables the operative to feel that locking has been effected correctly.

The invention also has for object a method for assembling the connector and the complementary connector of the assembly as described above, the method including the following steps:

making the connection via their front face between connector and complementary connector, causing the interface part to rotate by means of a tool so as to cause the locking cap to slide in translation from its unlocking position to its locking position in which it is immobilised relative to the casing of the connector.

The invention has numerous advantages compared to the prior art, among which may be cited:

a repetitive and precise locking position of the locking cap;

easy locking for operatives even in very restricted spaces;

the possibility for operatives to apply a very high locking force using an easily manipulated tool, which makes the equipped connection assembly perfectly compatible with applications in an environment subjected to high-intensity vibrations.

Numerous applications are envisaged for the invention among which may be cited electrical connections on aircraft.

Other advantages and features of the invention will become clearer on reading the detailed description of examples of embodiments of the invention given by way of non-limiting illustration with reference to the following figures.

DETAILED DESCRIPTION

Throughout the present application the terms "vertical", "lower", "upper", "low", "high", "below" and "above" are to be understood with reference to an electrical connector in accordance with the invention with its casing and its locking cap in a horizontally arranged configuration.

Likewise, the terms "internal" and "external" are to be understood relative to the casing of the electrical connector in accordance with the invention.

For clarity, the same reference number is used for the same element of a prior art electrical connection assembly and an electrical connection assembly in accordance with the invention.

Figure 1:
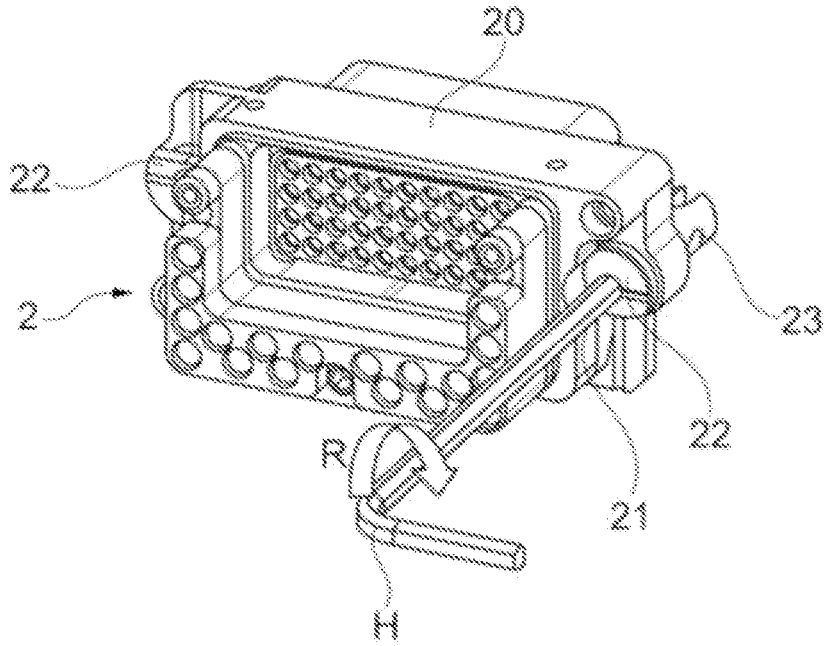
Fig. 1 (PRIOR ART)
FIG. 1 represents in perspective an example of a quarter-turn locking system used for the mutual locking between two multi-contact connectors of a prior art electrical connection assembly.
Figure 2A:
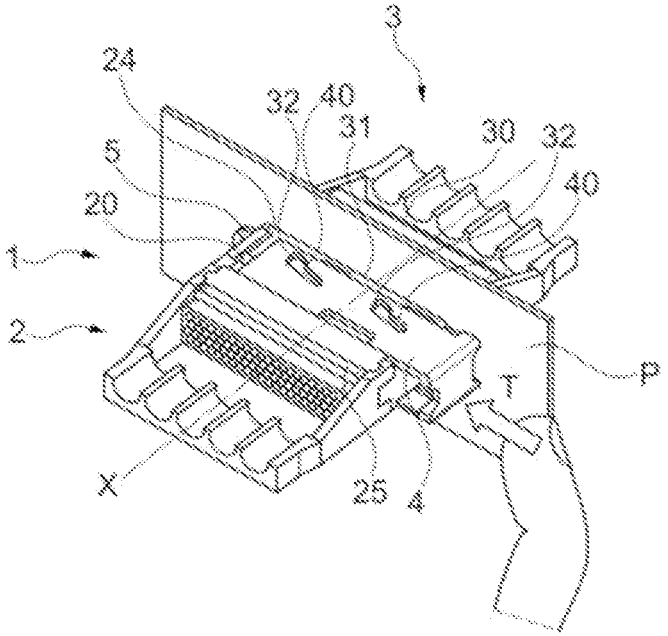
Fig. 2A (PRIOR ART)
FIG. 2A is a view from above and partly in section and as if by transparency of a prior art electrical connection assembly with a cap for mutual locking of the multi-contact connectors in its unlocking position.
Figure 2B:
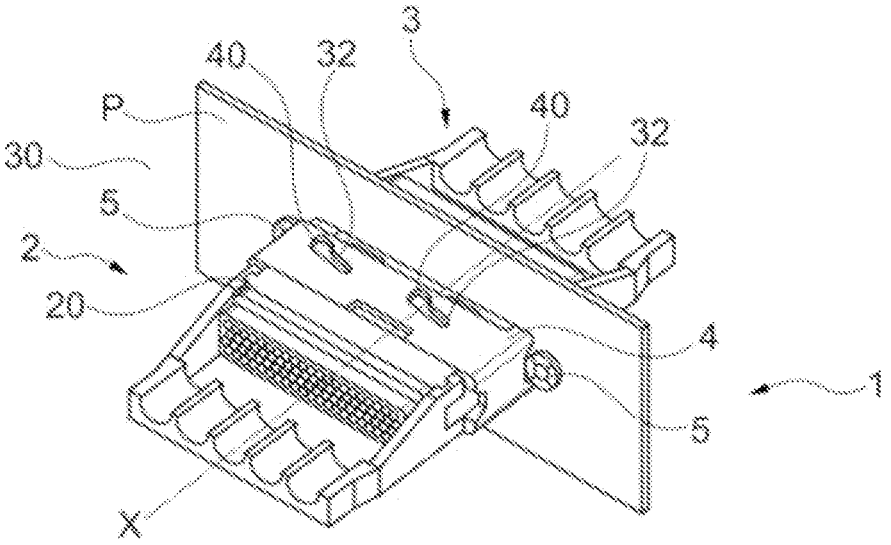
Fig. 2B (PRIOR ART)
FIG. 2B is a view from above and partly in section and as if by transparency of an electrical connection assembly according to FIG. 2A with the locking cap in its locking position.
Figure 3:
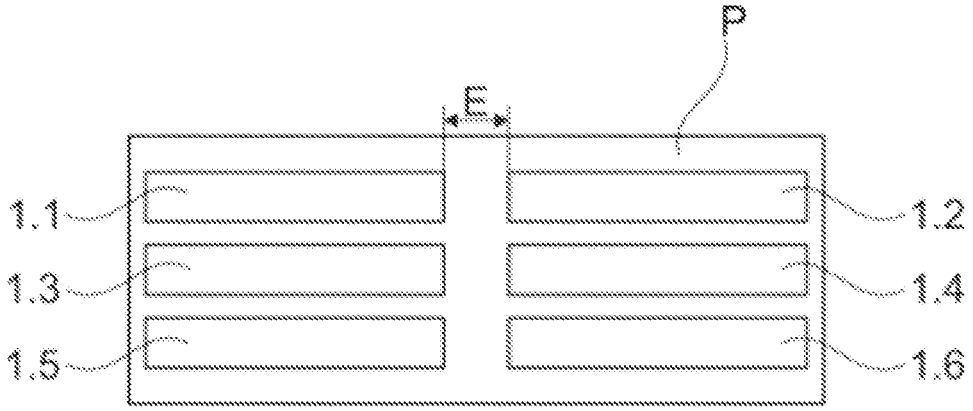
FIG. 3 is a front view of an electronic equipment panel with a required example of arranging a plurality of electrical connection assemblies with multi-contact connectors.

FIGS. 1 to 3 have already been described in detail in the preamble. They will therefore not be commented on hereinafter.

Figure 4:
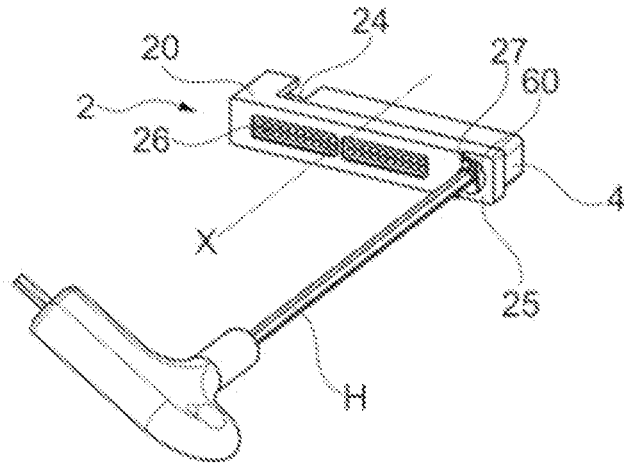
FIG. 4 is a perspective view showing an example of a plug type multi-contact connector with a locking cap in accordance with the invention to be moved by means of a hexagonal key type tool.
Figure 4A:
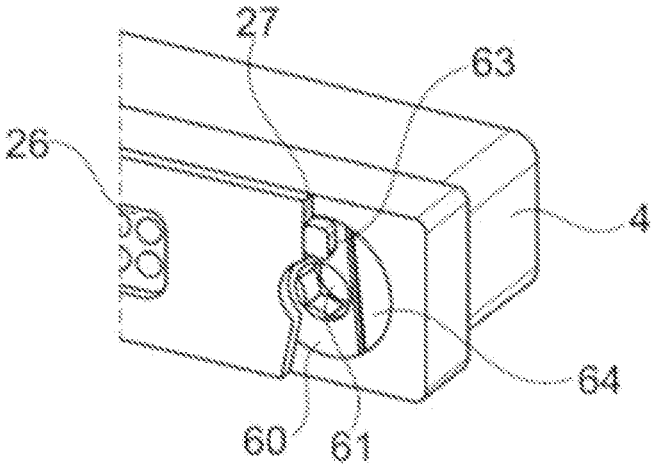
FIG. 4A is a detail perspective view of FIG. 4 without the tool.
Figure 5:
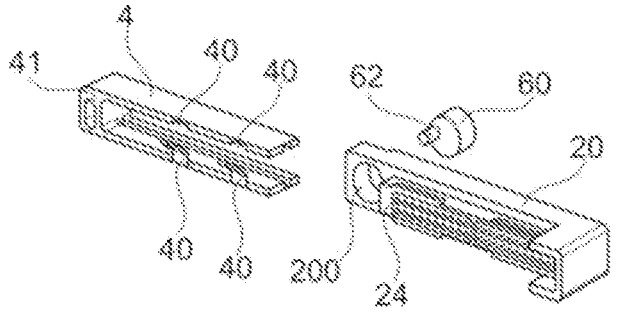
FIG. 5 is a perspective view of the casing, the locking cap and the interface part in accordance with the invention of the connector from FIG. 4.

There has been represented in FIG. 4 an example of a plug type connector in accordance with the invention, globally designated by the reference 2.

The male type multi-contact connector 2, in particular a plug, is intended to be connected to a female type complementary connector 3, in particular a receptacle.

The connectors 2 and 3 are intended to convey optical, radio-frequency, electrical or power signals.

This multi-contact connector 2 extends along a longitudinal axis X and comprises a casing 20 that in the example described is made in one piece from plastic material. The front face 24 and the rear face 25 of the casing 20 are parallel and extend perpendicularly to the axis X. An insert 26 with a plurality of cells is housed in the casing 20. Each cell is intended to house a contact that is not represented.

A locking cap 4 is mounted to slide on the casing 20, transversely to the longitudinal axis X, to lock the connectors 2 and 3 together when they are in the connected configuration, that is to say coupled to one another. As illustrated, the locking cap has a substantially U shape in a plane perpendicular to the longitudinal axis X.

In accordance with the invention, a sliding mechanism 6 is provided to transform the movement in rotation of a tool H into a movement in translation of the locking cap 4 from its unlocking position in which the two connectors 2, 3 are unlocked to its locking position in which they are locked.

The sliding mechanism 6 firstly comprises an interface part 60 that is able to cooperate with the tool H, which is preferably a hexagonal section key. The interface part 60 is mounted to rotate freely in a housing 200 of the connector casing 20.

To be more precise, the interface part 60 further comprises an interface imprint 61 for the tool H, preferably a hollow hexagonal imprint. In the example illustrated the imprint 61 is arranged on the side of the rear face of the casing, on a lateral edge of the latter.

The interface part 60 comprises as its periphery a pin 62 projecting toward the front face 24 of the casing 20.

The locking cap 4 comprises inside the bottom 41 of the U shape a groove 42 having a shape complementary to that of the pin.

Figure 6:
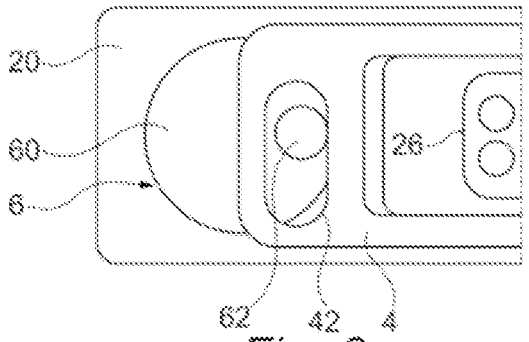
FIG. 6 is a view from the front and as if by transparency of the connector and the locking cap in the locking position, showing the sliding mechanism in accordance with the invention.

As shown in FIG. 6, the pin 62 is mounted to slide in the groove 42. The shape of the groove 42 is such that when the interface part 60 is caused to rotate by the tool H over an angular travel of at least 180° in the example illustrated the pin 62 sliding in the groove 42 slides the cap from its unlocking position to its locking position as described hereinafter.

The interface part 60 comprises at its periphery a lug 63 projecting from the side of the rear face 25 of the casing 20. This lug 63 abuts against a relief 27 fastened to or integral with the casing 20 both in the locking position and in the unlocking position of the cap 4.

The interface part 60 finally comprises, by way of visual indicator, a visible coloured zone 64, i.e. one that is visible to an operative, from the unlocking position of the cap 4 to its locking position, in which the zone is concealed by the relief 27 and/or the casing 20 itself.

There is now described with reference to FIGS. 8A to 8F the method in accordance with the invention of fixing, connecting and locking a connection assembly to a panel P. The panel P is for example integrated into the casing of electronic equipment, for example equipment onboard an aircraft, or into a disconnect panel.

Figure 7A:
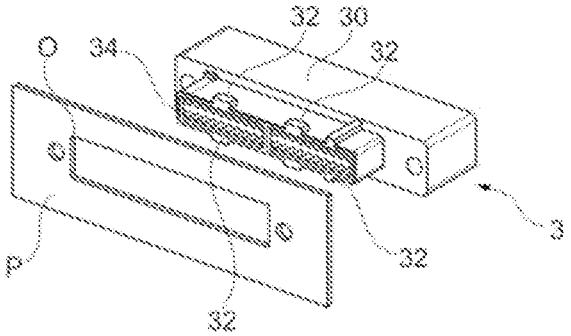
FIG. 7A is a perspective view showing a step of mounting a connection assembly in accordance with the invention in an electronic equipment panel.

Step a/: the operative moves toward the opening O in the panel P the receptacle 3 with its casing 30 in which is housed at least one insert 35 with cells for housing contacts (FIG. 7A).

Figure 7B:
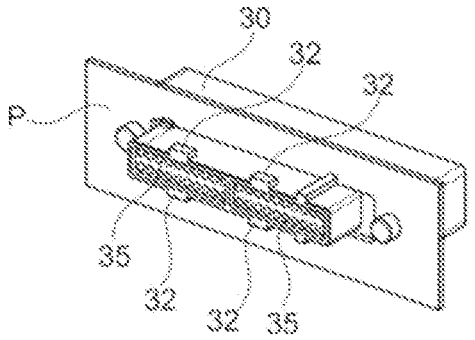
FIG. 7B is a perspective view showing a step after the step from FIG. 7A of mounting the connection assembly in the electronic equipment panel.

Step b/: the operative then inserts the receptacle 3 in the opening O in the panel P, centres it, and then fixed it to the panel with fixing screws (FIG. 7B).

Figure 7C:
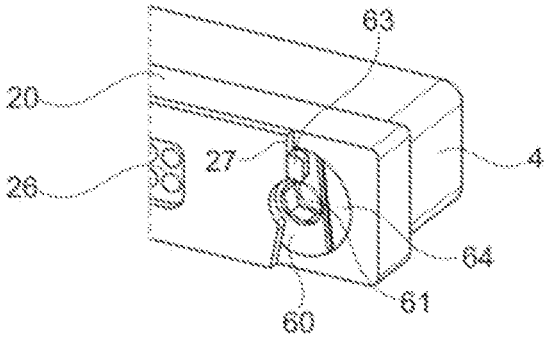
FIG. 7C repeats FIG. 4A and illustrates the unlocking position of the locking cap in accordance with the invention, with the visual indication for an operative of that position.

Step c/: the operative then picks up the plug type connector 2 with its locking cap 4 in its unlocking position (FIG. 7C). The operative is sure that the cap 4 is indeed in that unlocking position because on the one hand the lug 63 is abutted against the relief 27 and on the other hand the coloured zone 64 is completely visible, which indicates visually to the operative said unlocking position.

Figure 7D:
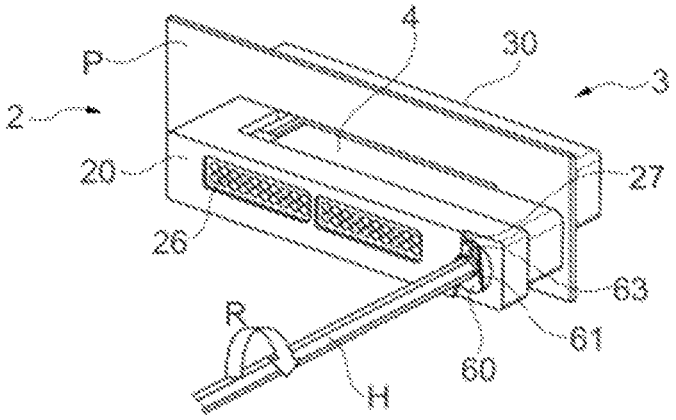
FIG. 7D is a perspective view showing a mounting step after the step from FIG. 7C, in which the connection between the two connectors of the connection assembly has been made and the locking of the two connectors of the connection assembly has not yet been effected (locking cap in open position).

Step d/: the operative then offers up the plug 2 with its contacts inserted in and fixed into the insert 26 housed in the casing 20 facing the receptacle 3 in such a manner as to couple them together via their front face 24, 34 to make the connection (FIG. 7D).

Figure 7E:
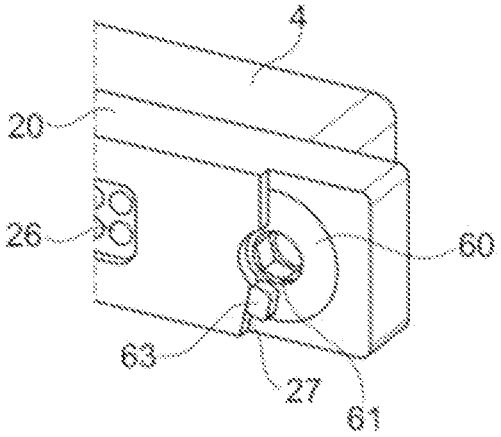
FIG. 7E repeats FIG. 4A but illustrates the locking position of the locking cap in accordance with the invention with the visual indication for an operative of that position.

Step e/: once this connection has been made, the operative can then proceed to the mutual locking thereof by causing the locking cap 4 to slide on the casing 3 from its unlocking position (FIG. 7D) to its locking position (FIG. 7E).

To this end they insert a hexagonal key H into the hexagonal imprint 61 and effect a rotation of at least 180°.

The operative is sure that the cap 4 is indeed in the locking position because on the one hand the lug 63 is abutted against the relief 27 and on the other hand the coloured zone 64 is completely invisible to the operative because concealed (FIG. 7E), and finally they have felt the sudden reduction of the rotation torque to be applied.

Locking proper is effected by immobilising the cap 4 in its locking position obtained by wedging the casing 30, that is to say by wedging each lug 32 of the casing 30 inside a groove 40 of the cap 4.

The operation of the sliding mechanism 6 is explained with reference to FIGS. 8A to 8C and 9A to 9C.

Figure 8A:
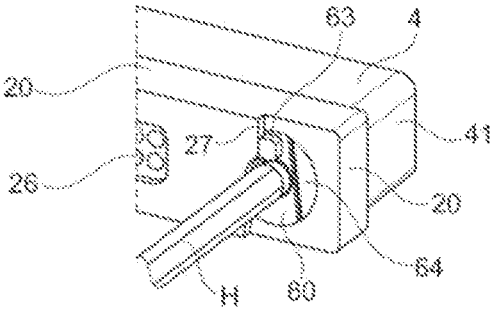
FIG. 8A is a detail perspective view of the rear of a connector and of the cap with the locking tool, in the unlocking position.
Figure 9A:
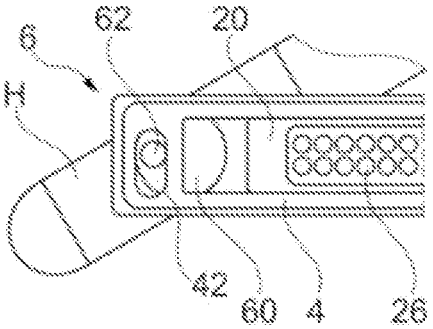
FIG. 9A, corresponding to FIG. 8A, is a view from the front and as if by transparency of the connector and the locking cap in the unlocking position.

In the unlocking position of the cap 4 the lug 63 is abutted against the relief 27 and the coloured zone 64 is completely visible, which indicates visually to the operative said unlocking position (FIG. 8A). The pin 62 is accommodated in a central part of the groove 42 (FIG. 9A).

Figure 8B:
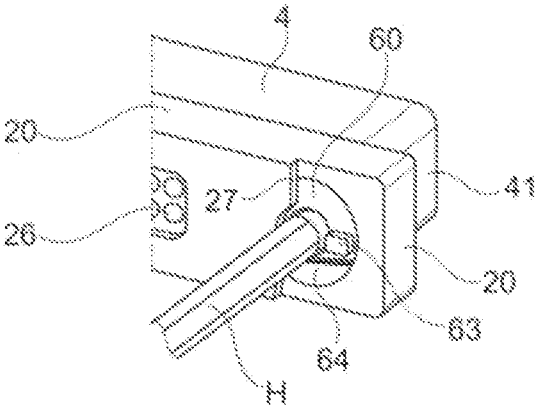
FIG. 8B is a detail perspective view of the rear of a connector and of the cap with the locking tool, in an intermediate position between the unlocking position and the locking position.
Figure 9B:
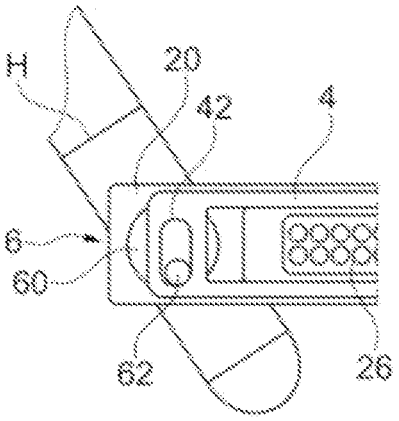
FIG. 9B, corresponding to FIG. 8B, is a view from the front and as if by transparency of the connector and the locking cap in an intermediate position between the unlocking position and the locking position.

When the operative has turned the key H through an angle of approximately 90°, the cap 4 is in an intermediate sliding position, the lug 63 is then free of any abutment and the coloured zone 64 is still visible, which indicates visually to the operative that they have not reached the locking position (FIG. 8B). The pin 62 is accommodated in the bottom end of the groove 42 (FIG. 9B).

Figure 8C:
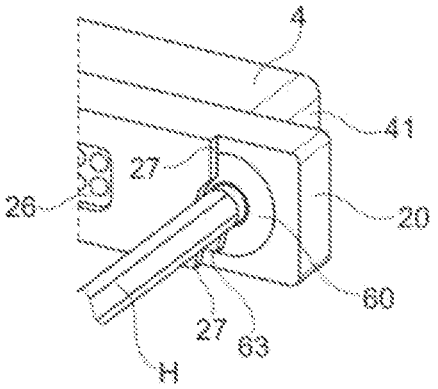
FIG. 8C is a detail perspective view of the rear of a connector and of the cap with the locking tool, in the locking position.
Figure 9C:
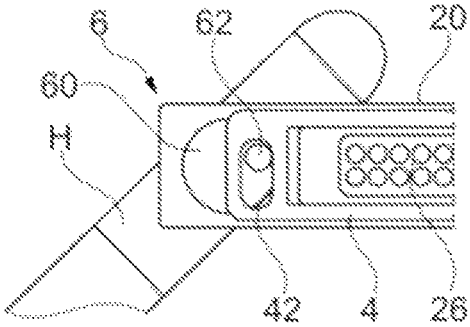
FIG. 9C, corresponding to FIG. 8C, is a view from the front and as if by transparency of the connector and the locking cap in the locking position.

When the operative has turned the key H by an additional angle of approximately 90°, i.e. a travel of approximately 180° from the unlocking position, the cap 4 is in its locking position, the lug 63 is then abutted against the relief 27 at the bottom and the coloured zone 64 is completely concealed (FIG. 8C). The pin 62 is accommodated in the top part of the groove 42 (FIG. 9C).

The end of travel position of the pin 62 in the groove 42 advantageously makes it possible to create a haptic indication of finalised locking in the vicinity of the locking position of the cap 4.

Indeed, when this complete locking position is reached and the cap 4 locked by wedging it, the pin 62 can continue to move in the groove 42, which is reflected for the operative in a sensation of sudden reduction of the force, that is to say a much lower rotation torque.

Other variants and improvements may be provided without this departing from the scope of the invention.

The invention claimed is:

1. Connector comprising:

a casing with a longitudinal axis (X), comprising a front face, termed the connection face, through which is made the connection to a connector of complementary type comprising a complementary casing, and a rear face, a cap for locking the connector to the complementary connector, said cap being mounted on the casing and adapted to slide transversely relative to the longitudinal axis (X) of the casing between an unlocking position and a locking position between casing and complementary casing, a mechanism for transformation of movement in rotation into sliding of the locking cap, the mechanism comprising an interface part for a tool (H), the part being mounted to rotate freely in a housing of the casing and adapted to be rotated, around an axis substantially parallel to the longitudinal axis (X) of the casing, by the tool over an angular travel causing the locking cap to slide from its unlocking position to its locking position and vice versa.

2. The connector according to claim 1, the interface part comprising an imprint as an interface for the tool.

3. The connector according to claim 1, the interface part being adapted to be caused to rotate by a movement in rotation of the tool.

4. The connector according to claim 3, the interface part being adapted to be caused to rotate about an axis parallel to the rotation axis of the tool.

5. The connector according to claim 4, the mechanism being a sliding mechanism in which:

the interface part comprises at its periphery a pin projecting toward the front face of the casing, the cap comprises a groove of complementary shape to that of the pin, the pin being mounted to slide in the groove, the shape of which is such that when the interface part is caused to rotate by the tool over the angular travel the pin sliding in the groove slides the cap from its unlocking position to its locking position and vice versa.

6. The connector according to claim 5, the end of travel position of the pin in the groove being adapted to generate for the operative effecting the locking using the tool (H) a haptic indication of finalised locking of the cap in the locking position or in the vicinity of the latter.

7. The connector according to claim 6, the pin being able to continue to slide in the groove beyond the locking position and to generate for the operative a sensation of sudden reduction of the rotational torque.

8. The connector according to claim 1, the interface part comprising at its periphery a lug projecting from the side of the rear face of the casing, the lug forming an abutment for the interface part against a relief produced in the casing or attached to the latter in the locking position and/or in the unlocking position of the cap.

9. The connector according to claim 8, the lug being visible to the operative effecting the locking using the tool (H) in any position of the cap.

10. The connector according to claim 1, comprising at least one visual indicator arranged so as to be visible to an operative in any position from the unlocking position of the cap to its locking position in which it is concealed.

11. The connector according to claim 10, the interface part comprising, by way of visual indicator, a visible coloured zone.

12. The connector according to claim 1, the cap and the interface part being sized so as to generate a locking force of at least 100 N.

13. The connector according to claim 1, the locking cap having in a plane perpendicular to the longitudinal axis (X) a substantially U shape.

14. Electrical connection assembly, comprising:

the connector according to claim 1, a complementary connector.

15. Method for assembling the connector and the complementary connector of the assembly according to claim 14, the method including the following steps:

making the connection via their front face between connector and complementary connector, causing the interface part to rotate by means of a tool (H) so as to cause the locking cap to slide in translation from its unlocking position to its locking position in which it is immobilised relative to the casing of the connector.

* * * * *